US006055002A

United States Patent [19]

Wen et al.

[11] Patent Number: 6,055,002

[45] Date of Patent: Apr. 25, 2000

[54] MICROFLUIDIC PRINTING WITH INK FLOW REGULATION

[75] Inventors: Xin Wen; Werner Fassler, both of Rochester; Charles D. DeBoer, Palmyra, all of N.Y.

[73] Assignee: Eastman Kodak Company, Rochester, N.Y.

[21] Appl. No.: 08/868,477

[22] Filed: Jun. 3, 1997

[51] Int. Cl.[7] ..... B41J 2/05

[52] U.S. Cl. ..... 346/140.1; 347/3

[58] Field of Search ..... 346/140.1; 347/3, 347/62

[56] References Cited

U.S. PATENT DOCUMENTS

| | | | |
|---|---|---|---|
| 4,782,347 | 11/1988 | Kurematsu et al. | 346/140.1 |
| 5,023,625 | 6/1991 | Bares et al. | 347/48 |
| 5,140,339 | 8/1992 | Higuma et al. | 347/43 |
| 5,473,350 | 12/1995 | Mader et al. | 347/7 |
| 5,745,128 | 4/1998 | Lam et al. | 346/140.1 |
| 5,771,810 | 6/1998 | Wolcott | 347/3 |
| 5,847,723 | 12/1998 | Akahira et al. | 347/14 |

*Primary Examiner*—N. Le
*Assistant Examiner*—Lamson D. Nguyen
*Attorney, Agent, or Firm*—Raymond L. Owens

[57] ABSTRACT

A microfluidic printing apparatus responsive to an image file for printing a plurality of pixels on a display is disclosed. The apparatus includes a plurality of ink delivery chambers; ink channels for delivering ink to each ink delivery chamber; and heater elements associated with particular delivery chambers and effective for causing the transfer of heat to inks in such chambers for regulating ink flow from the ink delivery chambers to the display. The apparatus further includes a circuit for controlling the heater elements for regulating the ink flow in response to the code values of the image file.

6 Claims, 5 Drawing Sheets

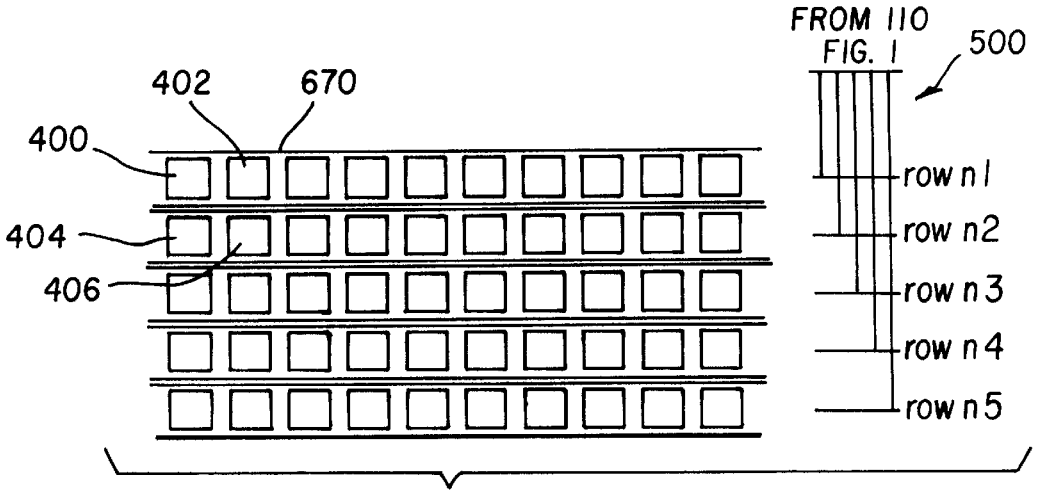
FIG. 8
FIG. 9
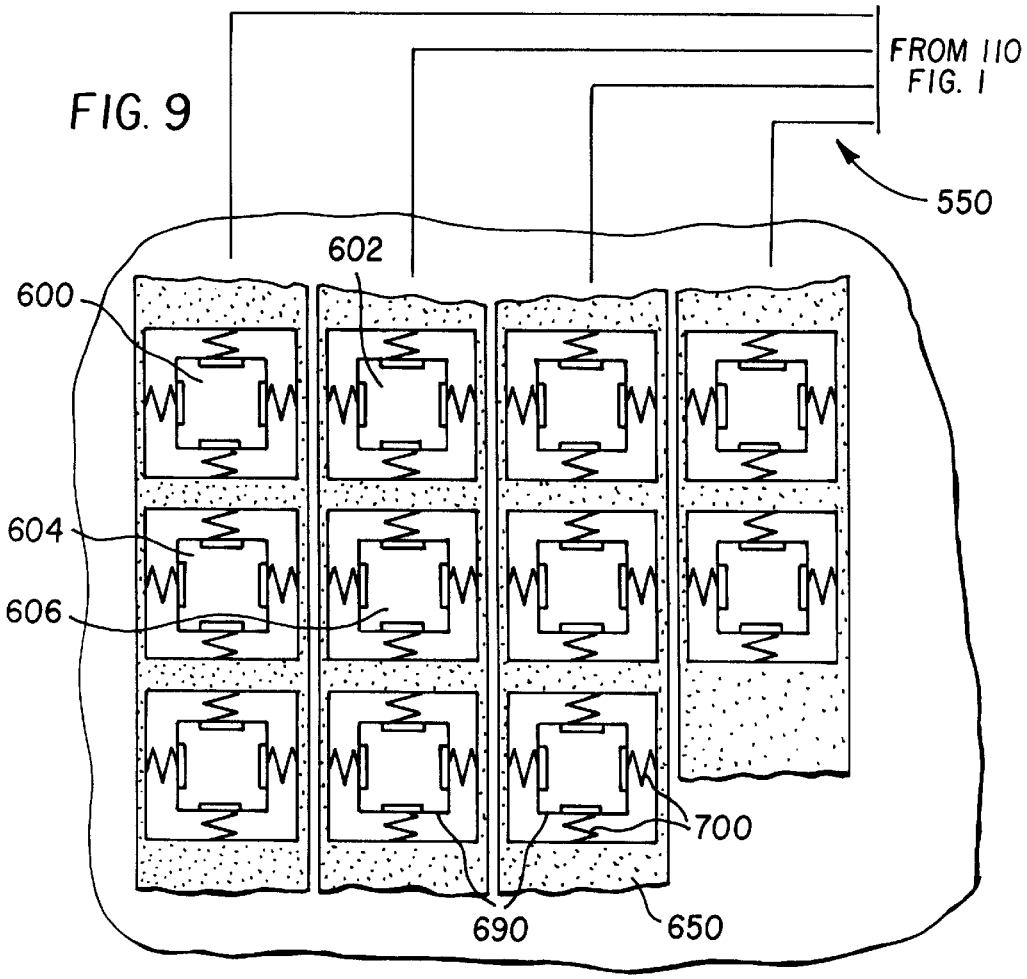

MICROFLUIDIC PRINTING WITH INK FLOW REGULATION

CROSS REFERENCE TO RELATED APPLICATIONS

Reference is made to commonly assigned U.S. patent application Ser. No. 08/868,426, filed Jun. 3, 1997 entitled "Continuous Tone Microfluidic Printing" (75863); U.S. patent application Ser. No. 08/868,104, filed Jun. 3, 1997 entitled "Image Producing Apparatus for Microfluidic Printing" (75921); U.S. patent application Ser. No. 08/868,100, filed Jun. 3, 1997 entitled "Improved Image Producing Apparatus for Uniform Microfluidic Printing" (75,945); U.S. patent application Ser. No. 08/868,416, filed Jun. 3, 1997 entitled "Microfluidic Printing on Receiver" (75,927); and U.S. patent application Ser. No. 08/868,102, filed Jun. 3, 1997 entitled "Microfluidic Printing With Ink Volume Control" (75864). The disclosure of these related applications is incorporated herein by reference.

FIELD OF THE INVENTION

The present invention relates to microfluidic printing apparatus for printing a plurality of pixels.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc., and hereby incorporated by reference. The system uses an array of reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analyses", Anal. Chem. 66, pp 1792–1798 (1994). The chemical reagent solutions are pumped from a reservoir, mixed in controlled amounts, and then pumped into a bottom array of reaction cells. The array may be decoupled from the assembly and removed for incubation or analysis.

The above described microfluidic pumping can be used as a printing device. The fluids pumped become ink solutions comprising colorants such as dyes or pigments. The array of reaction cells may be considered ink delivery chambers to be used for picture elements, or pixels, in a display, comprising mixtures of pigments having the hue of the pixel in the original scene. When contacted with paper, the capillary force of the paper fibers draws the dye from the cells and holds it in the paper, thus producing a paper print, similar to a photograph, of the original scene.

A problem that exists with the microfluidic printing is the difficulty in controlling the amount of inks transferred from the ink delivery chambers to a receiver. During printing, the ink meniscus in the ink mixing pixel chambers is brought into contact with the receiver medium. The inks are absorbed by the receiver medium by the capillary action of the fibers or pores in the receiver medium. Since the capillary force in the receiver medium is typically much stronger than the holding strength of the microchannels in the microfluidic printing device, the ink transfer needs to be stopped at just the right time to prevent excess inks from being continually drawn from the microchannels in the microfluidic printing device. Furthermore, the amount of ink transfer varies as a function of temperature, because the ink viscosity is temperature dependent. As it is well know to those skilled in the art, excessive ink transfer to the receiver medium causes severe coalescence or smearing of the ink on the receiver, which produces visible image artifacts and lowers the printing resolution. Excess ink transfer also causes blending between inks of different colors which produces image defects and variability in color balance.

SUMMARY OF THE INVENTION

An object of this invention is to provide high quality ink images.

Another object of this invention is to regulate the ink flow of ink to a receiver to print colored pixels.

Another object of this invention is to provide apparatus that regulates ink-flow that is robust.

Another object of this invention is to reduce the sensitivity of the print quality to temperature variations.

These objects are achieved by a microfluidic printing apparatus responsive to an image file for printing a plurality of pixels on a display, comprising:

a) a plurality of ink delivery chambers;

b) ink channels for delivering ink to each ink delivery chamber;

c) heater elements associated with particular delivery chambers and effective for causing the transfer of heat to inks in such chambers for regulating ink flow from the ink delivery chambers to the display; and d) means for controlling the heater elements for regulating the ink flow in response to the code values of the image file.

ADVANTAGES

One feature of apparatus in accordance with the present invention improves the regulation of the ink transfer and reduces print image artifacts on a receiver.

Another feature of apparatus in accordance with the present invention is that it can use a wide variety of receiver media.

Still another feature of the present invention is that the ink flow is regulated without using moving mechanical components.

BRIEF DESCRIPTION OF THE DRAWINGS

FIG. 8 is a cross-sectional view of the microchannel and showing conducting circuit connections in FIG. 6; and FIG. 9 is a detailed view of the micronozzles and microheaters in FIG. 7.

DETAILED DESCRIPTION OF THE INVENTION

The present invention is described in relation to a microfluidic printing apparatus which can print computer generated images, graphic images, line art, text images and the like, as well as continuous tone images. In the embodiment described electrokinetic pumps are used, but the present invention can use other microfluidic pumps.

Figure 1:
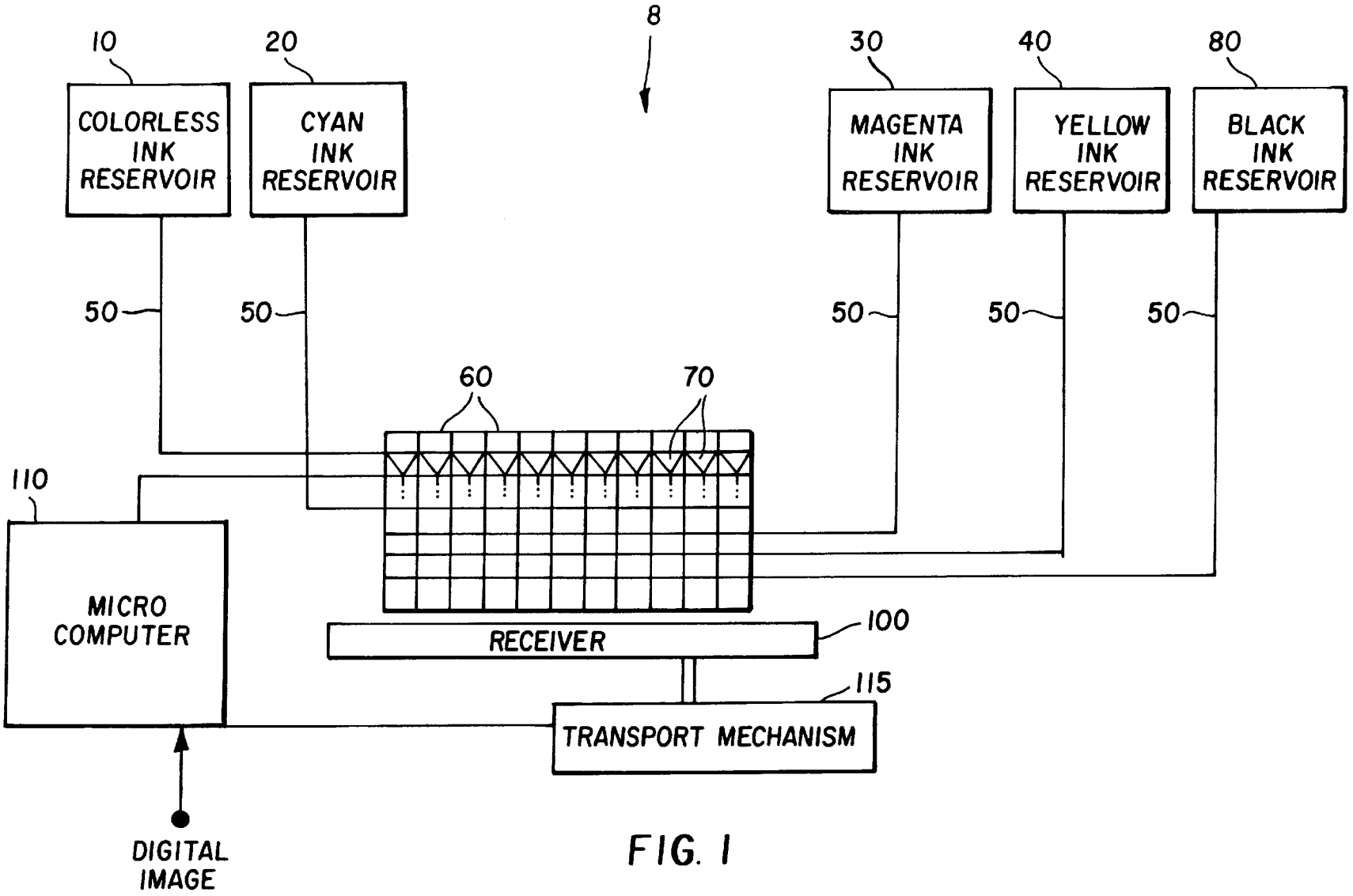
FIG. 1 is a partial schematic view showing a microfluidic printing system for printing a digital image on a reflective receiver.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink mixing chambers 60. In the present invention, the ink mixing chambers 60 delivery the inks directly to a receiver; however, other types of ink delivery arrangements can be used such as microfluidic channels, and so when the word chamber is used, it will be understood to include those arrangements. The colored inks are delivered to ink mixing chambers 60 by electrokinetic pumps 70. The amount of each color ink is controlled by microcomputer 110 according to the input digital image. For clarity of illustration, onl one electrokinetic pump 70 is shown for the colorless ink channel. Similar pumps are used for the other color channels, but these are omitted from the figure for clarity. Finally, a reflective receiver 100 is transported by a transport mechanism 115 to come in contact with the microfluidic printing apparatus. The receiver 100 receives the ink and thereby produces the print.

Figure 2:
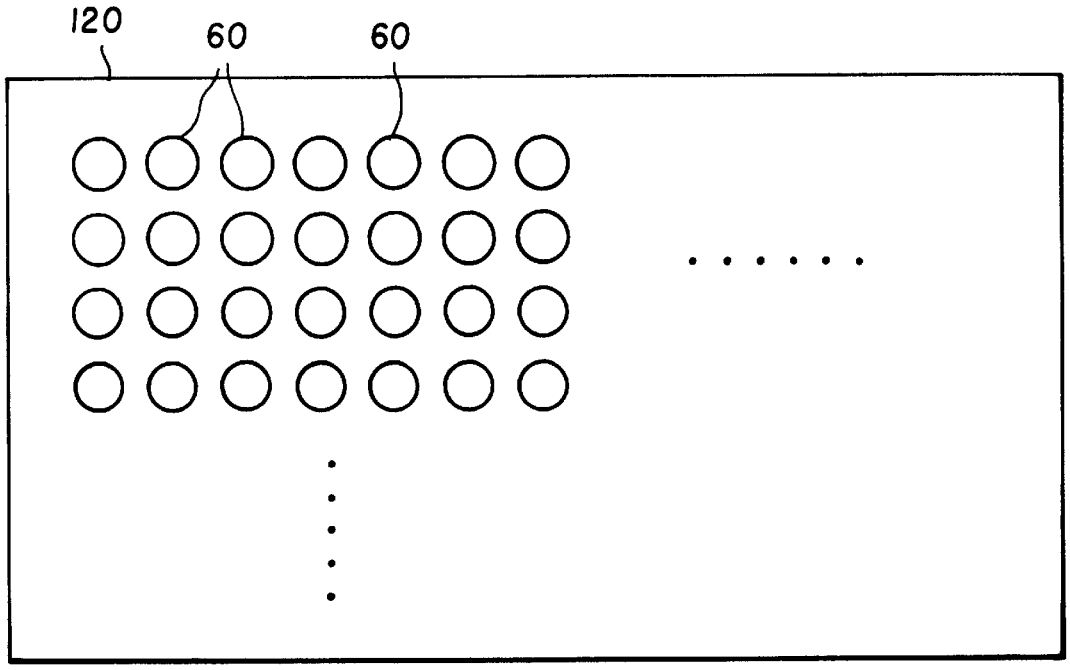
FIG. 2 is a top view of a pattern of the color pixels described in the present invention.

FIG. 2 depicts a top view of an arrangement of mixing chambers 60 shown in FIG. 1. Each ink mixing chamber 60 is capable of producing a mixed ink having any color saturation, hue and lightness within the color gamut provided by the set of cyan, magenta, yellow, and colorless inks used in the apparatus.

The inks used in this invention are dispersions of colorants in common solvents. Examples of such inks may be found is U.S. Pat. No. 5,611,847 by Gustina, Santilli and Bugner. Inks may also be found in the following commonly assigned U.S. patent applications (Docket Nos. 74,250AEK, 74,201AEK and 74,200 AEK) by McInerney, Oldfield, Bugner, Bermel and Santilli, and in U.S. patent application (Docket 74,595JRE) by Bishop, Simons and Brick, and in U.S. patent application (Docket 74,683JRE) by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention. The colorless ink changes the saturation or lightness of the inks mixed in a mixing chamber to provide a desired color.

The microchannel capillaries, ink pixel mixing chambers and microfluidic pumps are described in the references listed above.

Figure 3:
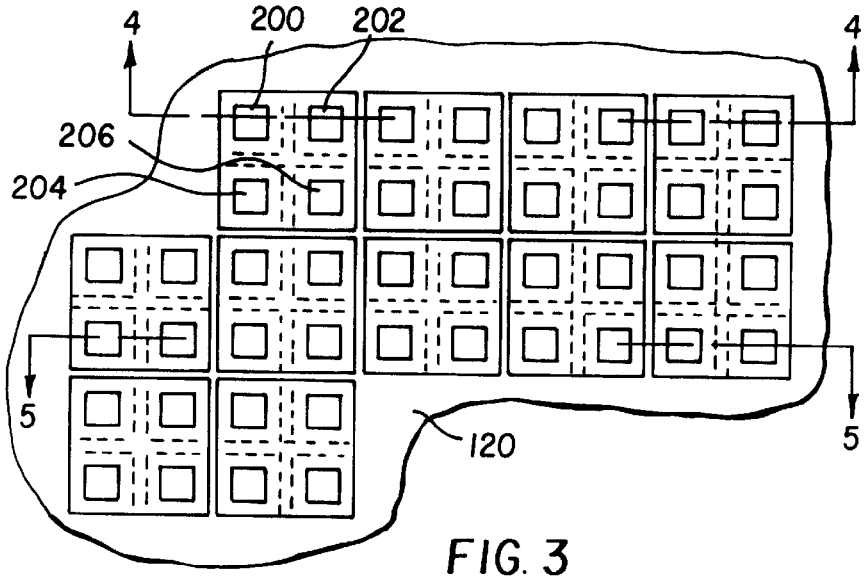
FIG. 3 is a top view of a second pattern of the color pixels described in the present invention.

FIG. 3 illustrates the arrangement of a second pattern of color pixels in the present invention. The ink mixing chambers 60 are divided into four groups cyan ink mixing chamber 200; magenta ink mixing chamber 202; yellow ink mixing chamber 204; and black ink mixing chamber 206. Each chamber is connected only to the respective colored ink reservoir and to the colorless ink reservoir 10. For example, the cyan ink mixing chamber 200 is connected to the cyan ink reservoir and the colorless ink reservoir so that cyan inks can be mixed to any desired lightness. When the inks are transferred to the reflective receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Figure 4:
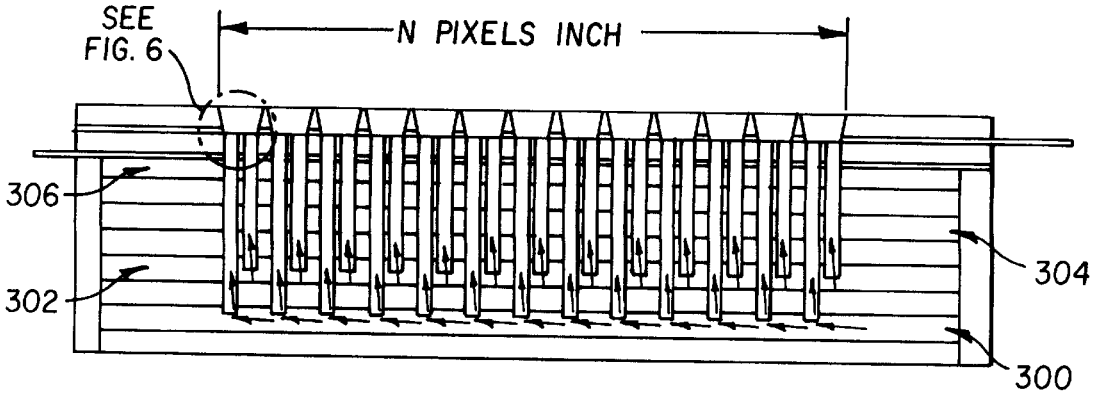
FIG. 4 is a cross-sectional view taken along the lines 4—4 of the microfluidic printing apparatus in FIG. 3.
Figure 5:
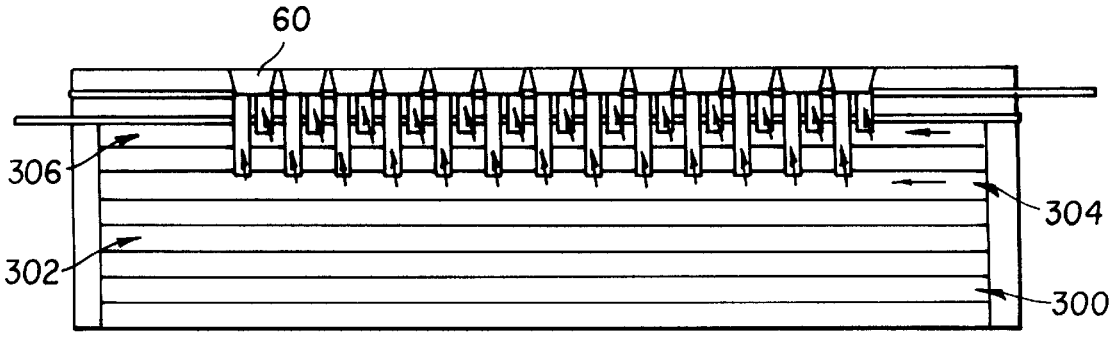
FIG. 5 is another cross-sectional view taken along the lines 5—5 of the microfluidic printing apparatus in FIG. 3.

Cross-sections of the color pixel arrangement shown in FIG. 3 are illustrated in FIG. 4 and FIG. 5. The colored ink supplies 300, 302, 304, and 306 are fabricated in channels parallel to the printer front plate 120. The cyan, magenta, yellow and black inks are respectively delivered by colored ink supplies 300, 302, 304, and 306 into each of the colored ink mixing chambers.

Figure 6:
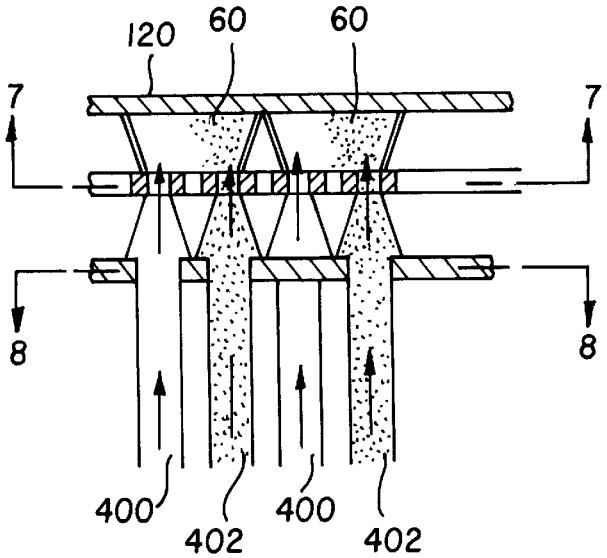
FIG. 6 is an enlarged view of the circled portion of FIG. 4.

A detail of the cross-sectional view in FIG. 4 is illustrated in FIG. 6. The colored inks are delivered to the ink mixing chambers respectively by cyan, magenta, yellow, and black ink microchannels 400, 402, 404, and 406 (404 and 406 do not show in FIG. 6, but is illustrated in FIG. 8). The colored ink microchannels 400, 402, 404, and 406 are respectively connected to the colored ink supplies 300, 302, 304, and 306 (FIGS. 4 and 5). The colorless ink is supplied to the ink mixing chamber, but is not shown in FIG. 6 for clarity of illustration.

Figure 7:
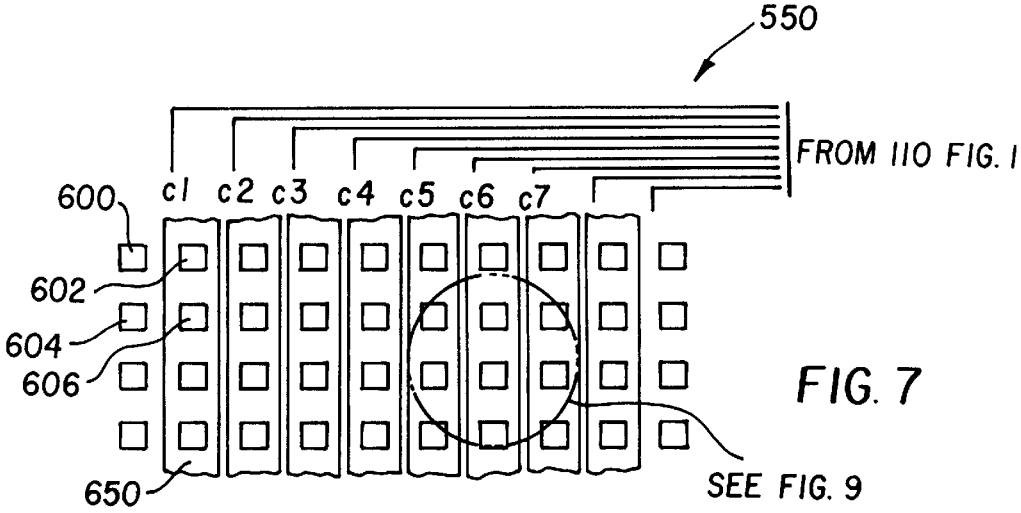
FIG. 7 is a cross-sectional view of the micronozzles shown in FIG. 6.

A partial cross-sectional view of the micronozzles in FIG. 6 is shown in FIG. 7. The cyan, magenta, yellow, and black ink micronozzles 600, 602, 604, and 606 are distributed in the same arrangement as the colored ink micro channels 300–304 and the colored ink mixing chambers 200–206. The pinch electrodes in the electrokinetic pumps for delivering the colored inks and the microheaters are not shown for clarity of illustration. The column electrodes 650 are connected to the pinch electrode 690 and the microheaters 700, which are illustrated in detail in FIG. 9. The column electrodes 650 are shown connected to the conducting circuit 550, which are further connected to microcomputer 110.

A cross-sectional view containing the microchannels in FIG. 6 is shown in FIG. 8. The color ink channels 400–406 are laid out in a spatial arrangement that corresponds to those in FIGS. 3 and 7. The lower electrodes in the electrokinetic pumps delivering the colored inks are not shown for clarity of illustration. A row of electrodes 670 are connected to lower electrodes of the electrokinetic pumps. The row electrodes 670 are shown connected to the conducting circuit 500, which is further connected to microcomputer 110.

A detail view of FIG. 7 is illustrated in FIG. 9. The pinch electrodes 690 and the microheaters 700 are connected to the column electrodes 650, which is further connected microcomputer 110 by conducting circuit 550. An electric potential difference is provided by a pump control (not shown) between the conducting circuits 500 and 550. The pump control is further controlled by a microcomputer 110. The electric potential difference induces an electric current in the resistive microheaters 700 and establishes an electric field between the pinch electrodes 690 and the lower electrodes (row electrodes 670) in the electrokinetic pumps. The viscosity of the ink fluid decreases as the microheaters 700 heat up the ink fluid. The micronozzles 600–606 are designed to be in smaller diameters than those of the microchannels so that the inks are inhibited from flowing through the micronozzles 600–606 when the microheaters 700 are not activated, that is, when the ink fluids are at higher viscosity. When the microheaters 700 are activated, the temperature of the inks is elevated, the viscosity of the ink is reduced, the ink can flow through the micronozzle to the ink mixing chamber.

In an alternative design, the microheaters are controlled by a separate electric circuit from the electric circuit that controls the bias voltage between the pinch electrodes and the lower electrodes in the electrokinetic pumps 70. The heating and pump actions can activated independently by the microcomputer 110.

The typical printing operation in the present invention involves the following steps. First the printer receives a digital image file including electronic signals which represent color code values and are characterized by bit depths of an essentially continuous tone image, for example, 8 bits per color per pixel. The color code values at each pixel, which define the lightness, hue and color saturation at the pixel. Details of computing ink volumes and the pump parameters are disclosed in the above referenced, commonly assigned U.S. patent application Ser. No. 08/868,104, filed Jun. 3, 1997 to Wen entitled "Image Producing Apparatus for Microfluidic Printing" (75921). In the default non-printing mode, the microheaters 700 are not activated and the no bias voltage is applied between the row and the column electrodes. The inks are not delivered into the ink mixing chambers 60. This prevents ink solutions from drying up at the outlets of the microchannels which often causes kogation problems in the microchannels. When the printing command is received by the printer, the microcomputer 110 activates the microheaters 700 which heats up the ink fluids and lowers the viscosity of the ink fluids. The microcomputer 110 then applies a electric potential bias between the conducting circuits 500 and 550 through pump control. The electrokinetic pumps then delivers the colored inks to ink mixing chambers 60 from corresponding microchannels 300–306 and through corresponding micronozzles 400–406. After the pumping of the inks is completed in a duration computed as described in the above referenced, commonly assigned U.S. patent application Ser. No. 08/868,104, filed Jun. 3, 1997 to Wen entitled "Image Producing Apparatus for Microfluidic Printing" (75921), the microheaters 700 and the electric potential bias between the row and column electrodes are deactivated; the ink flow between the ink mixing chamber 60 and the ink micronozzles 600–606 are shut-off. The mixture of inks, which has the same hue, lightness and color saturation as the corresponding pixel of the original image being printed, is held in the mixing chamber 60 by the surface tension of the ink solution. The reflective receiver 100 is subsequently transported by transport mechanism 115 (FIG. 1) to contact with the ink meniscus of the ink mixing chambers 60. The ink mixture contained in the mixing chamber 60 is then drawn into the reflective receiver by the absorbing force (such as capillary action) of the pores in the receiver. Since the ink mixture in ink mixing chamber 60 are shut off from the ink supplies 300–306, the contact time for the ink transfer is no longer critical. In addition, because the ink mixture in ink mixing chamber 60 is isolated, the requirement on the receiver type is much relaxed, that is, the invention printing apparatus is applicable to a wide variety of receivers.

Such receivers include common bond paper, made from wood fibers, as well as synthetic papers made from polymeric fibers. In addition receivers can be made of non-fibrous construction, provided they absorb and hold the ink used in the printer.

One advantage of this invention is the improvement in the robustness in the ink flow. Since the ink is heated to an elevated temperature, the sensitivity of ink transfer to temperature variations known to microfluidic printing is much reduced. The better regulated ink transfer results high print image quality by the invention microfluidic printing apparatus.

Another advantage of the present invention is that the ink flow is regulated without using moving mechanical components-such as mechanical valves. Therefore the invention microprinting apparatus is to more reliable and easier to fabricate.

Although colored inks are used in microfluidic printing as example in the current application, the apparatus disclosed in the present invention are not limited to printing applications. The invention apparatus applies to other fluids.

The invention has been described in detail with particular reference to certain preferred embodiments thereof, but it will be understood that variations and modifications can be effected within the spirit and scope of the invention.

| PARTS LIST | |
|---|---|
| 8 | microfluidic printing system |
| 10 | colorless ink reservoir |
| 20 | cyan ink reservoir |
| 30 | magenta ink reservoir |
| 40 | yellow ink reservoir |
| 50 | microchannel capillaries |
| 60 | ink mixing chambers |
| 70 | electrokinetic pumps |
| 80 | black ink reservoir |
| 100 | receiver |
| 110 | microcomputer |
| 115 | transport mechanism |
| 120 | printer front plate |
| 200 | cyan ink mixing chamber |
| 202 | magenta ink mixing chamber |
| 204 | yellow ink mixing chamber |
| 206 | black ink mixing chamber |
| 300 | cyan ink supply |
| 302 | magenta ink supply |
| 304 | yellow ink supply |
| 306 | black ink supply |
| 400 | cyan ink microchannel |
| 402 | magenta ink microchannel |
| 404 | yellow ink microchannel |
| 406 | black ink microchannel |
| 500 | conducting circuit |
| 550 | conducting circuit |
| 600 | cyan ink micronozzle |
| 602 | magenta ink micronozzle |
| 604 | yellow ink micronozzle |
| 606 | black ink micronozzle |
| 650 | column electrodes |
| 670 | row electrodes |
| 690 | pinch electrodes |
| 700 | microheaters |

What is claimed is:

1. A microfluidic printing apparatus responsive to an image file having at least one code value for each pixel for printing a plurality of pixels on a display, comprising:

a) a plurality of ink delivery chambers each including an ink;

b) ink channels coupled to the ink delivery chambers for delivering ink to each ink delivery the chamber;

c) each of microfluidic pumps, each associated with a particular ink channel and effective for delivering the ink through each channel to each ink delivery chamber;

d) heater elements associated with the delivery chambers and effective for causing the transfer of heat to inks in such chambers for regulating ink flow from the ink delivery chambers to the display; and e) means for controlling the heater elements for regulating the ink flow in response to the code values of the image file.

2. A microfluidic printing apparatus responsive to an image file having at least one code value for each pixel for printing a plurality of colored pixels on a receiver, comprising:

a) a plurality of ink mixing chambers for receiving inks of different colors;

b) ink channels coupled to the ink mixing chambers, with each such channel delivering a particular colored ink to each ink mixing chamber for mixing of inks;

c) each of microfluidic pumps, each associated with a particular ink channel and effective for delivering a particular colored ink through each channel to each ink mixing chamber;

d) heater elements associated with the delivery chambers and effective for causing the transfer of heat to the colored inks mixed in such chambers for regulating ink flow from the ink mixing chambers to the medium; and e) means for controlling the heater elements for regulating the ink flow in response to the code values of the image file for printing said plurality of colored pixels on the receiver.

3. The apparatus of claim 2 further including at least one colorless ink which is delivered to each ink mixing chamber to adjust the saturation of mixed inks to control their tone.

4. The apparatus of claim 2 wherein the colored inks further include black ink.

5. A microfluidic printing apparatus responsive to an image file having at least one code value for each pixel for printing a plurality of colored pixels on a receiver, comprising:

a) a plurality of ink mixing chambers for receiving cyan, magenta, and yellow inks, each such chamber including a micronozzle;

b) ink channels coupled to the ink delivery chambers, with each such channel delivering a particular colored ink to each ink delivery chamber for mixing of inks to produce another particular colored ink;

c) a plurality of microfluidic pumps, each associated with each ink channel and effective for delivering a particular colored ink through each channel to each ink mixing chamber;

d) heater elements associated with each nozzle and effective for causing the transfer of heat to the colored inks mixed in such chambers for regulating ink flow from the ink mixing chambers to the medium; and e) means for controlling the heater elements for regulating the ink flow in response to the code values of the image file for printing said plurality of colored pixels on the receiver.

6. A microfluidic apparatus responsive to electrical input signals for controlling the mixing of fluids, comprising:

a) a plurality of chambers for receiving different fluids;

b) channels coupled to the chambers, with each such channel delivering a particular fluid to a particular chamber;

c) each of microfluidic pumps, each associated with a particular channel and effective for delivering a particular fluid through each channel to each chamber;

d) heater elements associated with each chamber and effective for causing the transfer of heat to the fluids for regulating fluid flow to the chamber; and e) means for controlling the heater elements for regulating the flow in response to the electrical signals.

* * * * *

UNITED STATES PATENT AND TRADEMARK OFFICE

CERTIFICATE OF CORRECTION

PATENT NO. : 6,055,002
DATED : April 25, 2000
INVENTOR(S) : Xin Wen, et al

It is certified that error appears in the above-identified patent and that said Letters Patent is hereby corrected as shown below:

| | |
|---|---|
| Column 6, claim 1, c) | "c) each of microfluidic pumps, each associated with a particular ink channel" should be replaced with --c) a plurality of microfluidic pumps, each associated with each ink channel-- |
| Column 7, claim 2, c) | "c) each of microfluidic pumps. each associated with a particular ink" should be replaced with --c) a plurality of microfluidic pumps, each associated with each ink--. |
| Column 8, claim 6, c) | "c) each of microfluidic pumps, each associated with a particular channel" should be replaced with --c) a plurality of microfluidic pumps, each associated with each channel--. |

Signed and Sealed this

Sixth Day of March, 2001

Nicholas P. Godici

*Attest:*

NICHOLAS P. GODICI

*Attesting Officer*

*Acting Director of the United States Patent and Trademark Office*